US010021950B2

(12) United States Patent
Li et al.

(10) Patent No.: US 10,021,950 B2
(45) Date of Patent: Jul. 17, 2018

(54) CURLING HAMMER AND OPERATING PRINCIPLE THEREOF

(71) Applicant: Zhejiang Yueli Electrical Co., Ltd., Zhejiang Province (CN)

(72) Inventors: Yong Li, Zhejiang Province (CN); Longxuan Li, Zhejiang Province (CN); Wenfei Xie, Zhejiang Province (CN)

(73) Assignee: ZHEJIANG YUELI ELECTRICAL CO., LTD., Ningbo, Zhejiang Province (CN)

( * ) Notice: Subject to any disclaimer, the term of this patent is extended or adjusted under 35 U.S.C. 154(b) by 121 days.

(21) Appl. No.: 14/742,044

(22) Filed: Jun. 17, 2015

(65) Prior Publication Data

US 2016/0255935 A1 Sep. 8, 2016

(30) Foreign Application Priority Data

Mar. 4, 2015 (CN) ..... 2015 1 0096199

(51) Int. Cl.

| | |
|---|---|
| ***A45D 2/36*** | (2006.01) |
| ***A45D 6/02*** | (2006.01) |
| *A45D 1/28* | (2006.01) |

(52) U.S. Cl.

CPC ..... *A45D 2/36* (2013.01); *A45D 2/367* (2013.01); *A45D 6/02* (2013.01); *A45D 1/28* (2013.01)

(58) Field of Classification Search

CPC ... A45D 1/02; A45D 1/04; A45D 1/28; A45D 2001/045; A45D 2/36; A45D 2/37; A45D 6/02; A45D 6/04

(Continued)

(56) References Cited

U.S. PATENT DOCUMENTS 4,177,824 A * 12/1979 Gnaga ..... A45D 2/36 132/238
8,646,465 B2 * 2/2014 Tam ..... A45D 2/12 132/211

(Continued)

FOREIGN PATENT DOCUMENTS

CN 203505855 U 4/2014
CN 203897569 * 10/2014 ..... A45D 1/04

(Continued)

OTHER PUBLICATIONS

Chinese Notification to Grant Patent Right dated Aug. 30, 2017 for Invention for Application No. CN201510096199.7.

(Continued)

*Primary Examiner* — Tatiana Nobrega
(74) *Attorney, Agent, or Firm* — The Dobrusin Law Firm, PC.

(57) ABSTRACT

The present invention discloses a hair curling hammer and an operation principle thereof. The hair curling hammer is made up of a handle housing component, a control member, a heating member, a power member, a hair curling member and a hair care member. The handle housing component comprises a first handle housing and a second handle housing, the control member comprises a button, a decoration fixing mount, a button divider and a PCB board. The power member, heating member, hair curling member and hair care member are arranged in the working part of the hair curling hammer together. The invention is adjustable in temperature, circling number of curling hair, case hardening time, and turning, which meets the various requirements of the customer; improves the hair curling member, the operability and reliability of curling hair greatly; and three hair combing brushes are added in to make the progress of curling hair more smooth.

15 Claims, 12 Drawing Sheets

(58) Field of Classification Search
USPC ..... 132/238, 237, 227, 229, 269
See application file for complete search history.

(56) References Cited

U.S. PATENT DOCUMENTS

2010/0263684 A1* 10/2010 De Benedictis ..... A45D 2/02 132/272
2013/0068245 A1* 3/2013 De Benedictis ..... A45D 2/02 132/237
2015/0114425 A1* 4/2015 Park ..... A45D 1/04 132/229
2015/0128987 A1* 5/2015 De Benedictis ..... A45D 2/02 132/238
2015/0189965 A1* 7/2015 Chung ..... A45D 2/367 132/230
2015/0196105 A1* 7/2015 Leung ..... A45D 1/04 132/228
2016/0206071 A1* 7/2016 Lee ..... A45D 1/04
2016/0255937 A1* 9/2016 De Benedictis ..... A45D 2/02
2017/0013928 A1* 1/2017 Debenedictis ..... A45D 2/001

FOREIGN PATENT DOCUMENTS

CN 203897569 U 10/2014
CN 203969569 U 12/2014

OTHER PUBLICATIONS

Chinese First Office Action dated Apr. 1, 2017, for Application No. CN201510096199.7.

* cited by examiner

CURLING HAMMER AND OPERATING PRINCIPLE THEREOF

BACKGROUND OF THE INVENTION

1. Field of the Invention

The invention relates to the technical field of daily hairdressing care tool, more specifically, to a hair curling hammer and operating principle thereof.

2. Description of the Related Art

The conventional hair curler mainly consist of a housing of the hair curler (to ensure the product is beautiful in appearance and easy to handle), a power supply line and plug (to ensure heat and power of the product), a motor and a hair curling structure (to ensure curled hair is beautiful), a heating structure (to ensure the hair style remains the same over time) and a switching operation system (the product needed to be set at different temperatures for operations for different consumer groups at different operating environment and under different climatic conditions, so that the products can be suitable for different hair qualities of users, and controls the on/off status of the power supply). As a handheld product, operation of the convention hair curler is quite complex, and a lot of experience is required for an operator to set suitable temperature

SUMMARY OF THE INVENTION

Therefore, the invention provides a hair curling hammer and its operating principle, to resolve the problem that a lot of experience is required for the operator to use the conventional hair curler skillfully due to its cumbersome operation. To achieve the above purpose, the technical scheme of the invention is as follows: A hair curling hammer, comprising a housing component, a control member, a heating member, a power member, a hair curling member and a hair care member, wherein, the housing component includes a first housing and a second housing, the two housings are detachably assembled by screws and form an outline of the hair curling hammer, and the hair curling hammer comprises a working part and a handheld part, the end portion of the handheld part is connected to the power line, the control member is fixed in the handheld part, a switch is arranged between the working part and handheld part of the hair curling hammer;

the control member includes a button, a decoration fixing mount, a button divider and a PCB (Printed Circuit Board), the button divider is arranged between the PCB and the decoration fixing mount, the button is arranged on the decoration fixing mount, the button divider and the button are fixed on the decoration fixing mount through screws and snaps by the PCB, the decoration fixing mount is fixed on the handheld part of the hair curling hammer, and the control member is connected to a power line;

the power member, the heating member, the hair curling member and the hair care member are arranged in the working part of the hair curling hammer, wherein, the power member includes a motor, an output gear, a base cover, an motor base, a connecting element and a Hall sensor, the motor base is fixed in the working part of the hair curling hammer, the motor is arranged in the motor base, the output gear is arranged on a motor drive shaft of the motor, the connecting element is inserted in a groove located at an upper part of the motor base, the base cover is sleeved on the connecting element and covers the motor base and the output gear on the motor, the Hall sensor is fixed on a lower part of the base cover;

the heating member includes a heat cover base, a heat cover, a sub heat cover, a heat cover lid, a PTC heater and an NTC temperature sensor, the heat cover base is fixed in the working part of the hair curling hammer and located on one side of the motor base, the sub heat cover is arranged in the heat cover base, the heat cover is sleeved on the connecting element, the PTC heater and the NTC temperature sensor are arranged in the heat cover, and the heat cover lid is embedded in the heat cover;

the hair curling member includes a hair curling arm, the hair curling arm is sleeved on the connecting element, a magnet is arranged on a lower part of the curling arm, two steel wires are arranged on the two ends of the hair curling arm respectively, a gear structure is arranged on the rear part of the hair curling arm, and the gear structure is engaged with the output gear;

the hair care member includes hair grip silica gels, hair combing brushes and a retaining wall of silica gel; the hair grip silica gels are arranged on a top of the housing of the working part of the hair curling hammer, the hair combing brushes are detachably assembled on periphery of the sub heat cover, the retaining wall of silica gel is detachably assembled on a fixed cover, the fixed cover is arranged on an outlet of the working part of the hair curling hammer.

The hair curling hammer as mentioned above, wherein the motor and the heat cover base are horizontally installed structures and are located at one side of the heat cover base and adjacent to an inner side of the working part of the hair curling hammer, and the motor is connected to the control member.

The hair curling hammer as mentioned above, wherein the motor and the heat cover base are horizontally installed structures and are below the heat cover base and adjacent to a bottom of the working part of the hair curling hammer, the motor drive shaft of the motor is connected to the output gear, the output gear is engaged with a transmission gear, the transmission gear is engaged with the gear structure of a rear part of the hair curling arm, the transmission gear is fixed on the motor base through a copper shaft, and the motor is connected to the control member.

The hair curling hammer as mentioned above, wherein the hair grip silica gels are arranged at an opening on the top of the handle housing of the hair curling hammer, the opening is rectangular in shape, and an orientation of the opening is in accordance with a direction of a length of the motor, the number of hair combing brushes is three and the three hair combing brushes are arranged on the heat cover base symmetrically with respect to the center of the heat cover.

The hair curling hammer as mentioned above, wherein the control member also includes a transparent decorative sheet and a decorative ring, a plurality of through holes, whose number and structure match with those of the button, are arranged on the transparent decorative sheet such that the buttons are accessible through the through holes, and the transparent decorative sheet is fixed on the decoration fixing mount, the decorative ring is detachably assembled on the decoration fixing mount by a snap; a slot, which matches with a structure of the snap of the decorative ring, is arranged on the decoration fixing mount, and the decoration fixing mount is detachably assembled on the housing component.

The hair curling hammer as mentioned above, wherein an end portion of the hair curling hammer connected to the power line has a junction box covered by a junction box lid.

The hair curling hammer as mentioned above, wherein the number of the hair grip silica gels is two and the two hair grip silica gels are symmetrically arranged on the top of the housing of the working part of the hair curling hammer, the two hair grip silica gels are adjacent to each other and two ends of the hair grip silica gels are in contact with each other at the opening on the top of the housing.

The hair curling hammer as mentioned above, wherein the number of the steel wires is two and the two steel wires are arranged on two ends of the curling arm respectively, and the two steel wires are fixed on the hair curling arm symmetrically by a steel wire fixing mount.

The hair curling hammer as mentioned above, wherein the magnet is initially arranged at a position opposed to the Hall sensor, a motor cover is arranged between the motor and the output gear, which is adjacent to the Hall sensor, and the motor cover is sleeved on the motor, and abuts against the motor base so as to seal the motor.

The hair curling hammer as mentioned above, wherein a copper bushing is sleeved between the hair curling arm and the connecting element, a plurality of step structures, which match each other, are arranged between the copper bushing and the hair curling arm.

The hair curling hammer as mentioned above, wherein a connecting element bush is sleeved on a joint of the heat cover and the connecting element, a plurality of step structures, which match with the heat cover and the connecting element bushing respectively, are arranged on the connecting element.

The hair curling hammer as mentioned above, wherein a switch cover is arranged on the switch, a spring is arranged between the switch cover and the switch, a spring groove is arranged on the switch cover for the installation of the spring, a mounting pillar is arranged on the switch for the installation of the spring, and the switch is rotatably connected to the switch cover.

The hair curling hammer as mentioned above, wherein a protection cover is arranged on a top of the hair curling hammer.

The hair curling hammer as mentioned above, wherein the button comprises a temperature control button, a circling number control button, a styling time control button and a rotational direction control button.

A method for operating a hair curling hammer, which is shown as follows: set a direction of rotation, temperature, styling time and circling number of times; place a strand of hair at an opening on a top of the hair curling hammer which is close to the hair grip silica gels; press a switch, and the motor starts to rotate; a steel wire on the hair curling arm is rotated and the hair is curled on a heat cover gradually; meanwhile, a heat generated from a heater inside the heat cover heats and shapes the hair curled on the heat cover, the retaining wall of silica gel prevents the hair from loosening so that the hair remains on the heat cover and is styled thereby; after the hair curling arm rotates a predefined circling number of times, the motor is stopped; after the styling time ends, a control member provides an alert, the hair is pulled out in a curled state and the hair curling is accomplished.

Due to the above technical aspects, the invention generates the following positive effects:

(1) The invention has a beautiful appearance, good human-computer interface, and is able to generate sufficient heat and power.

(2) The hair curling hammer of this invention is adjustable in temperature, circling number of times, styling time, and rotational direction, which meets the various requirements of the customer.

(3) The hair curling hammer of this invention improves on the hair curling member, the operability and reliability of curling hair greatly; three hair combing brushes are introduced, which make the process of curling hair smoother, keep the curled hair suppler, and more beautiful.

(4) Providing a retaining wall of silica gel of the hair curling hammer of this invention makes the operation more convenient.

(5) The implement of the two hair grip silica gels of the hair curling hammer of this invention simplifies the operation of the hair curling greatly, making the operation more convenient and more reliable.

(6) By the use of the steel wire, the hairs are dispersed by the fine steel wire when the hair is curled, which makes the haft supple, and the hair cannot be messy, and the attractiveness of the curled hair is ensured.

BRIEF DESCRIPTIONS OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
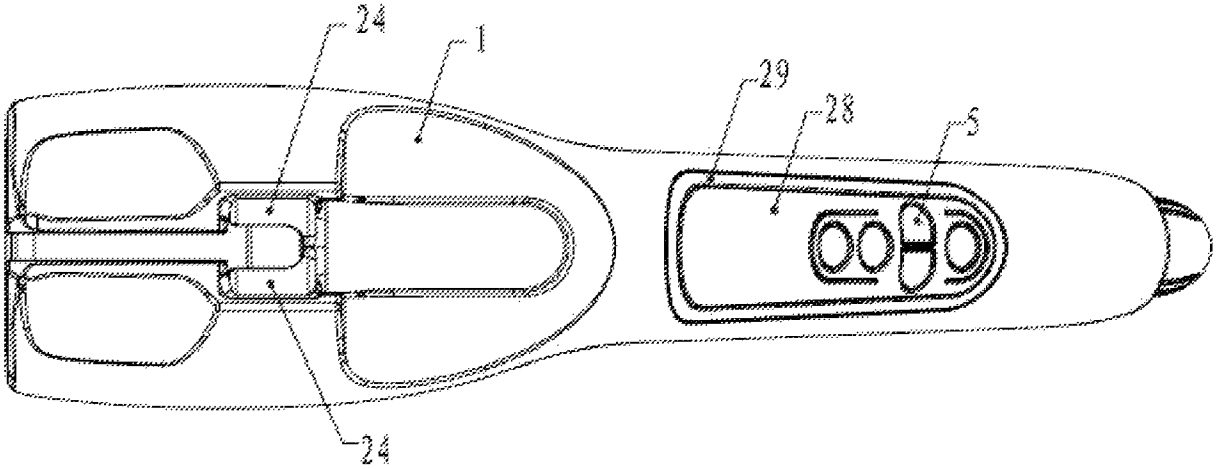
FIG. 1 shows a structure diagram of a first embodiment of the hair curling hammer of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "plurality" means a number greater than one.

Hereinafter, certain exemplary embodiments according to the present disclosure will be described with reference to the accompanying drawings.

Embodiment I

Figure 2:
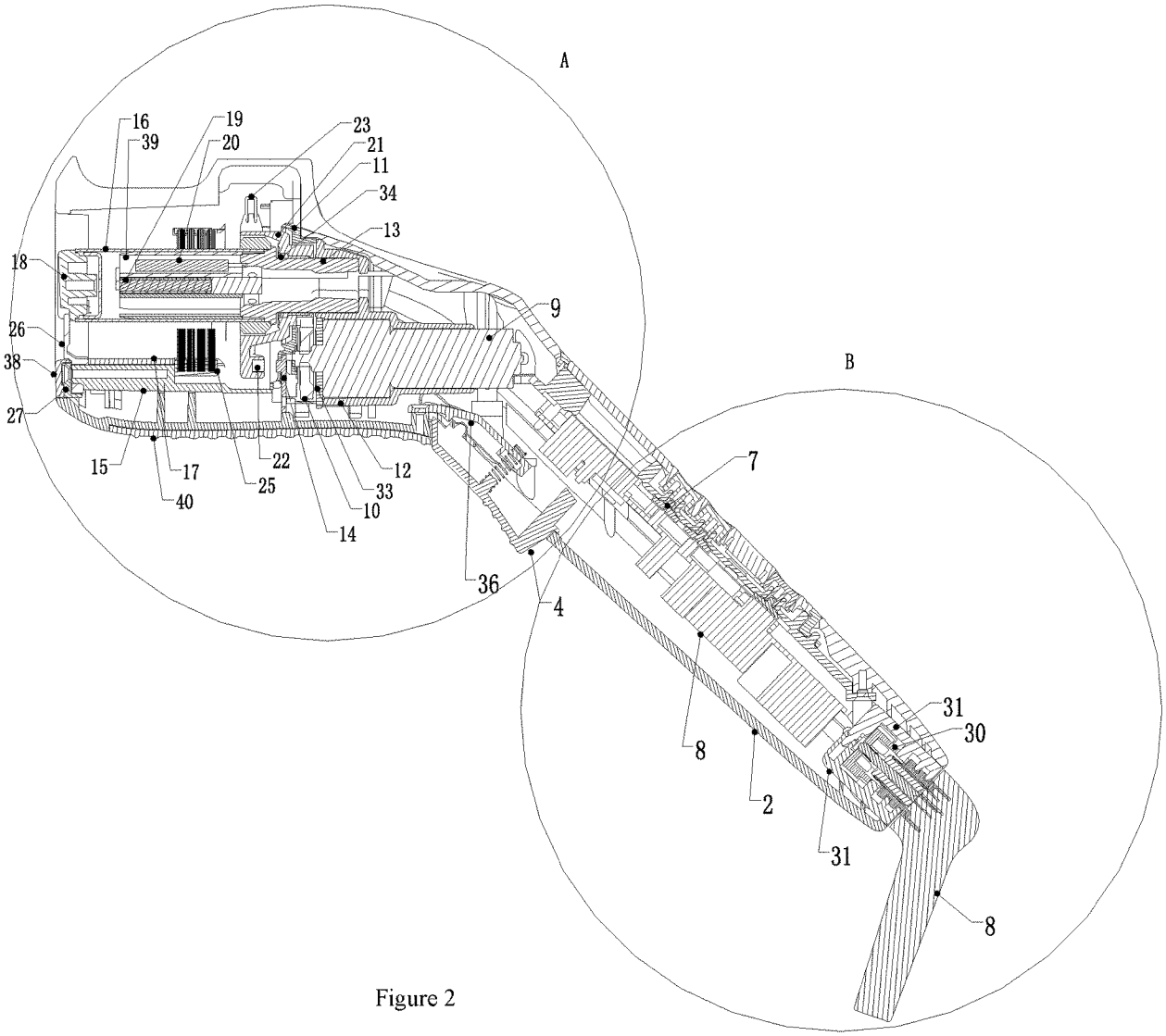
FIG. 2 shows a section view of a first embodiment of the hair curling hammer of the present invention.
Figure 3:
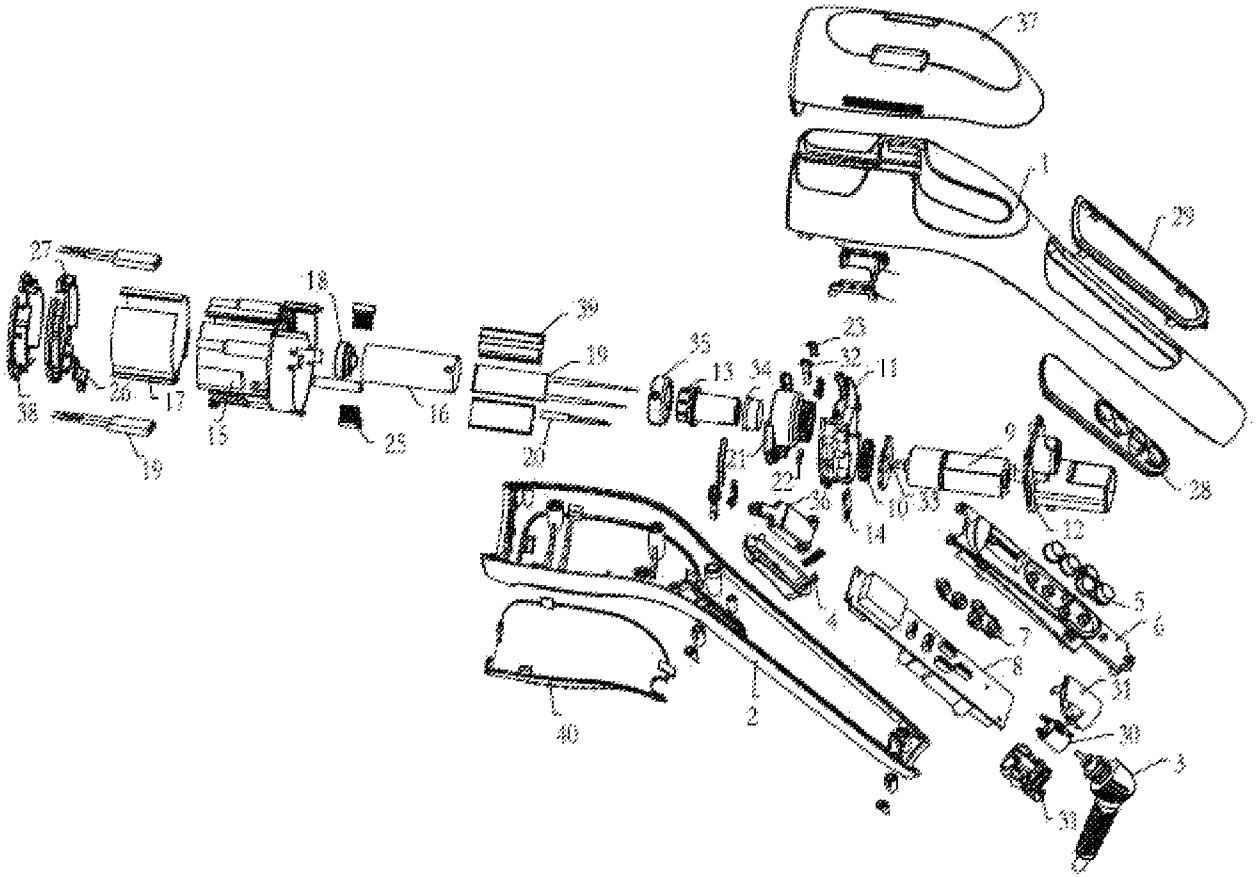
FIG. 3 shows an exploded view of a first embodiment of the hair curling hammer of the invention.

Referring to FIGS. 1 to 3, a hair curling hammer of the invention consists of a housing component, a control member, a heating member, a power member, a hair curling member and a hair care member, wherein:

the housing component includes a first housing 1 and a second housing 2, the two housings are detachably assembled by screws and form the outline of the hair curling hammer; the hair curling hammer comprises a working part and a handheld part, and the end portion of the handheld part is connected to the power source 3, which is connected to the power source, the control member is fixed in the handheld part, a switch 4 is arranged between the working part and handheld part of the hair curling hammer, the switch 4 functions as an operation control switch of the hair curling hammer; a junction box 30 is arranged at the junction of the end portion of the hair curling hammer and the power line 3, a junction box lid 31 is covered on the junction box 30; a protection cover 37 is arranged on the top of the hair curling hammer, a side decoration cover 38 is arranged on the outlet portion of the hair curling hammer, a lower decoration cover 40 is arranged on the bottom of the second handle housing 2, which makes the appearance beautiful.

The control member includes a button 5, a decoration fixing mount 6, a button divider 7 and a PCB 8, the button divider 7 is arranged between the PCB 8 and the decoration fixing mount 6, the button 5 is arranged on the decoration fixing mount 6, the button divider 7 and the button 5 is fixed on the decoration fixing mount 6 through the screws and the snaps by the PCB 8, the decoration fixing mount 6 is fixed on the handheld part of the hair curling hammer, and the control member is connected to the power line 3;

the power member, the heating member, the hair curling member and the hair care member are arranged in the working part of the hair curling hammer; wherein, the power member includes a motor 9, an output gear 10, a base cover 11, a actuating unit motor base 12, a connecting element 13 and a Hall sensor 14, the motor base 12 is fixed in the working part of the hair curling hammer, the motor 9 is arranged in the motor base 12, the output gear 10 is arranged on the motor drive shaft of the motor 9, the connecting element 13 is inserted in the groove of the upper part of the motor base 12, the base cover 11 is sleeved on the connecting element 13 and covers the motor base 12 and the output gear 10 of the motor 9 at the lower part, the Hall sensor 14 is fixed on a lower part of the base cover 11; the motor 9 and the heat cover base 15 are both horizontally installed structure and are located at one side of the heat cover base 15, and they are adjacent to an inner side of the working part of the hair curling hammer, and the motor 9 is connected to the control member.

The heating member includes a heat cover base 15, a heat cover 16, a sub heat cover 17, a heat cover lid 18, a PTC heater 19 and an NTC temperature sensor 20; the heat cover base 15 is fixed in the working part of the hair curling hammer and located on one side of the motor base 12, the sub heat cover 17 is arranged in the heat cover base 15, the heat cover 16 is sleeved on the connecting element 13, the PTC heater 19 and NTC temperature sensor 20 are arranged in the heat cover 16, the heat cover lid 18 is embedded in the heat cover 16, the PTC heater 19 is arranged on a PTC bracket 39, and the PTC bracket 39 is arranged in the heat cover base 15.

The hair curling member includes a hair curling arm 21, the hair curling arm 21 is sleeved on the connecting element 13, a magnet 22 is arranged on the lower part of the hair curling arm 21, two steel wires 23 are arranged on the two ends of the hair curling arm 21 respectively, a gear structure is arranged on the rear part of the hair curling arm 21, the gear structure is engaged with the output gear 10, the output gear 10 drives the hair curling arm 21 to rotate through the engaging structure so as to curl hair.

The hair care member includes hair grip silica gels 24, hair combing brushes 25 and a retaining wall of silica gel 26; the hair grip silica gels 24 are silica gels which hold the hair in position; the retaining wall of silica gel 26 prevents the hair from loosening off of the heat cover; the hair grip silica gels 24 are arranged on the top of the handle housing of the working part of the hair curling hammer, the top of the handle housing of the hair curling hammer is provided with an opening, the opening is used to configure the hair grip silica gels 24, the shape of the opening is rectangular, and the direction of the opening is the same as the direction of the length of the motor 9, the hair combing brushes 25 is detachably assembled on the circumference of the sub heat cover 17, the number of hair combing brushes 25 is three and the three hair combing brushes 25 are arranged on the heat cover base 15 symmetrically with respect to the center of the sub heat cover 17, the retaining wall of silica gel 26 is detachably assembled to a fixed cover 27, the fixed cover 27 is arranged at the outlet of the working part of the hair curling hammer.

The invention has following embodiments based on above embodiment, please continue referring to FIGS. 1 to 3.

In a further embodiment of the invention, the control member also includes a transparent decorative sheet 28 and a decorative ring 29, a plurality of through holes, whose number and structure match with those of the button 5, are arranged on the transparent decorative sheet 28, the button 5 extends through the through holes such that the buttons are accessible through the holes and are fixed on the decoration fixing mount 6, the decorative ring 29 is detachably assembled on the decoration fixing mount 6 through snaps; a slot, which matches with snap structure of the decorative ring 29, is arranged on the decoration fixing mount 6; the decoration fixing mount 6 is detachably assembled on the housing, the button 5 comprises a temperature control button, a circling number control button, a styling time control button and a rotational direction control button. The temperature control button sets the PTC heater to control the temperature for hair curling. The circling number control button controls the number of times the curling arm rotates. The styling time control button controls the styling time of the hair curled on the heat cover 16. The rotational direction control button controls the direction of rotation of the hair curling hammer.

In a further embodiment of the invention, the number of the hair grip silica gels 24 is two, and the two hair grip silica gels are symmetrically arranged on the top of the housing of the working part of the hair curling hammer, the two hair grip silica gels 24 are adjacent to each other and the two ends of the hair grip silica gel are in contact with each other at the opening on the top of the handle housing.

In a further embodiment of the invention, the number of the steel wires 23 is two and the two steel wires are arranged on the two ends of the hair curling arm 21 respectively, and they are fixed on the hair curling arm 21 symmetrically by a steel wire fixing mount 32.

In a further embodiment of the invention, the initial mounting positions of the magnet 22 and Hall sensor 14 are symmetrical, a motor cover 33 is arranged between the output gear 10, which is approximate to the Hall sensor 14, and the motor 9, the motor cover 33 sleeves on the motor 9 and engages to the motor base 12 so as to seal the motor 9.

In a further embodiment of the invention, a copper bushing 34 is sleeved between the hair curling arm 21 and the connecting element 13, a plurality of step structures, which match to each other, are arranged between the copper bush 34 and the hair curling arm 21.

In a further embodiment of the invention, a connecting element bushing 35 is sleeved on the joint of the heat cover 16 and the connecting element 13, a plurality of step structures, which match to the heat cover 16 and the connecting element bushing 35 respectively, are arranged on the connecting element 13.

In a further embodiment of the invention, a switch cover 36 is arranged on the switch 4, a spring is arranged between the switch cover 36 and the switch 4, a spring groove is arranged on the switch cover 36 for the installation of the spring, a mounting pillar is arranged on the switch 4 for the installation of the spring, and the switch 4 is rotatably connected to the switch cover 36.

The user can further understand the characters and features of the invention according to the following description. The embodiment also includes an operation principle of a hair curling hammer, wherein the operation principles are as follows:

Firstly, by pressing the power button for 2 seconds, the PTC heater starts to work. Secondly, after setting the direction of rotation, the required temperature for hair curling, the styling time and the circling number of times via several buttons, place a strand of hair at an opening on a top of the hair curling hammer which is close to the hair grip silica gels 24. And it should be noted that the hair curling hammer should be close to the end of hair so that most of the hair is curled by the hair curling hammer. Then press the switch 4 to start the hair curling hammer, and the motor 9 starts to rotate.

The steel wire 23 on the hair curling arm 21 is rotated and the hair is curled on the heat cover 16 gradually, the steel wire 23 can disperse the hair, so that the hair cannot be in mess. After the hair curling arm 21 rotates the predefined circling number of times, the motor stops rotating; at the same time, the PTC heater 19 in the heat cover 16 works and generates heat, the hair curled on the heat cover 16 is heated and shaped. The retaining wall of silica gel 26 prevents the hair from loosening which in turn ensures proper curling of the hair.

Finally, when the styling time ends, the control member buzzes and gives an alarm, the hair is pulled out slowly and the process of hair curling is complete.

Embodiment II

Figure 4:
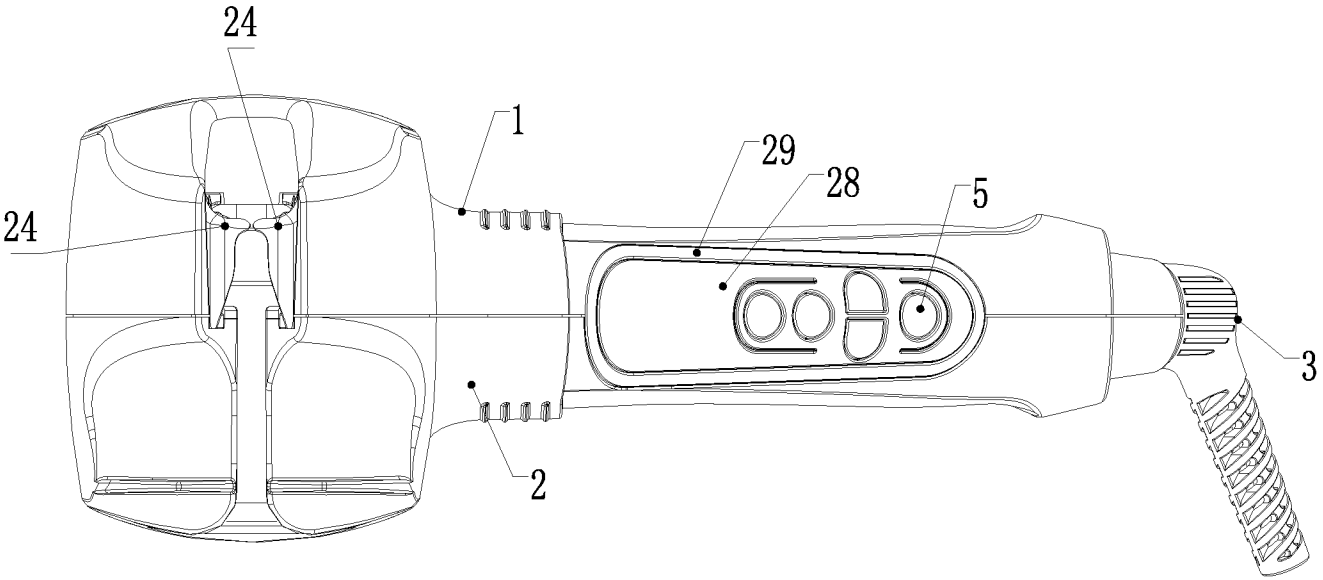
FIG. 4 shows a structure diagram of a second embodiment of the hair curling hammer of the invention.
Figure 5:
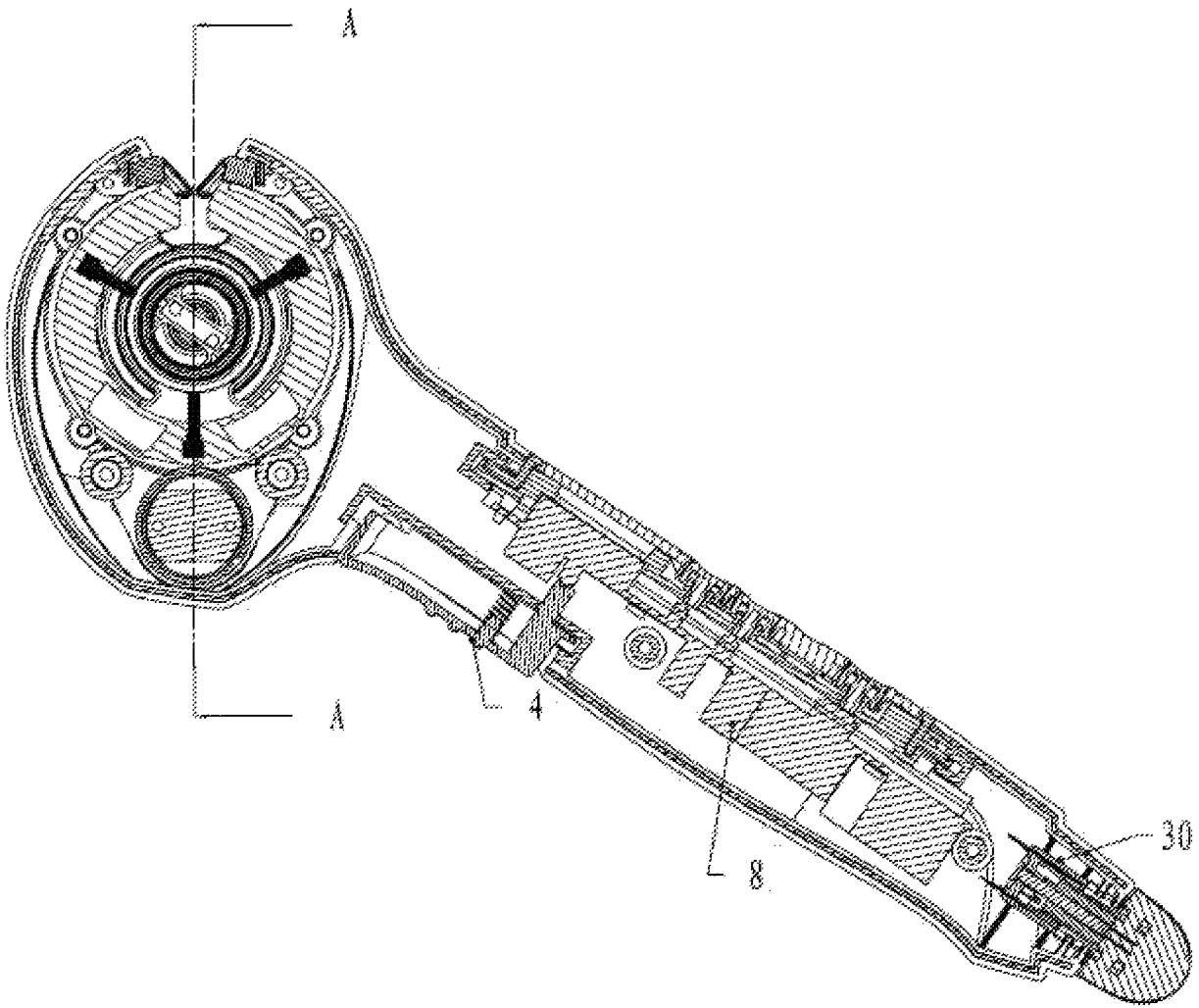
FIG. 5 shows a section view of a second embodiment of the hair curling hammer of the invention.
Figure 6:
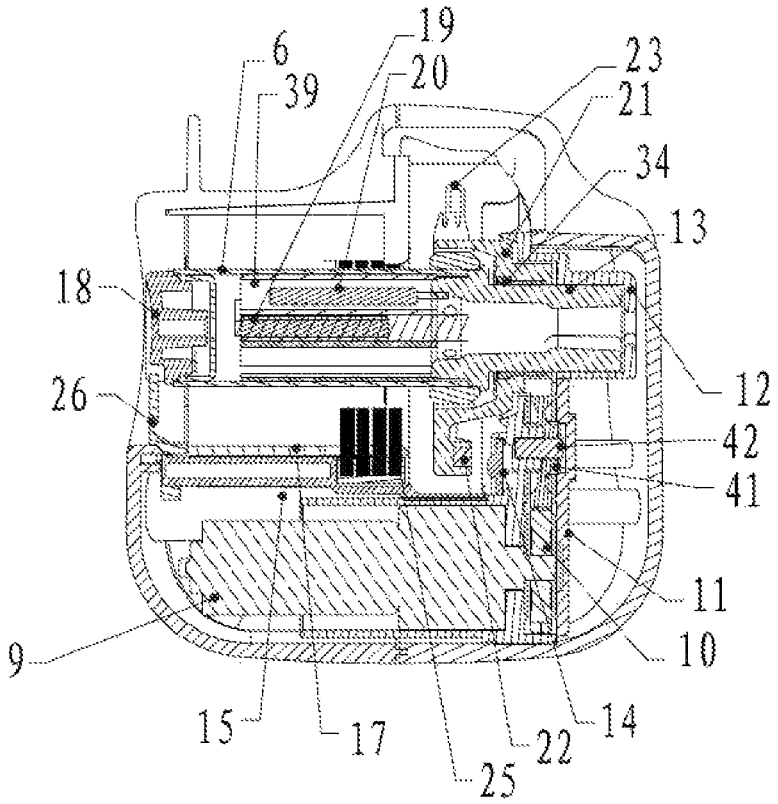
FIG. 6 is the A-A section view of FIG. 5.
Figure 7:
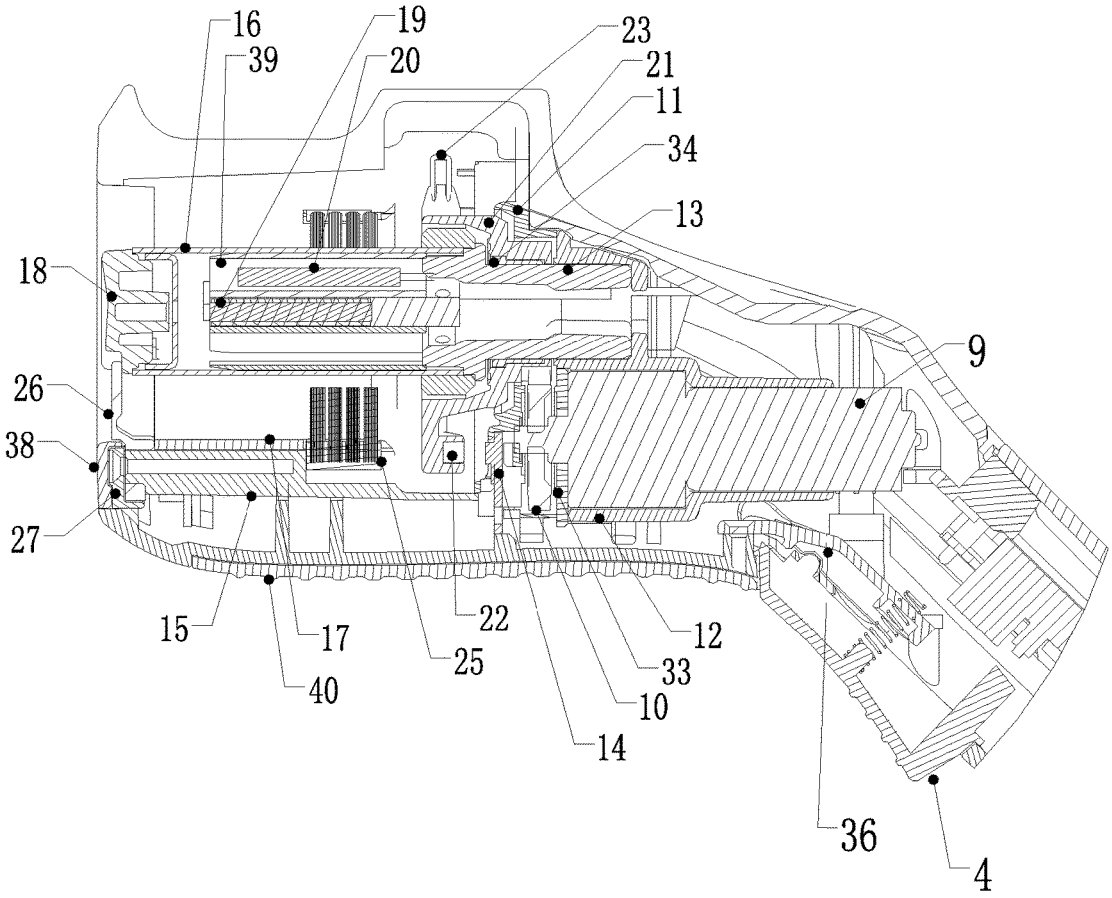
FIG. 7 is an enlarged view of the portion labeled with A in FIG. 2.
Figure 8:
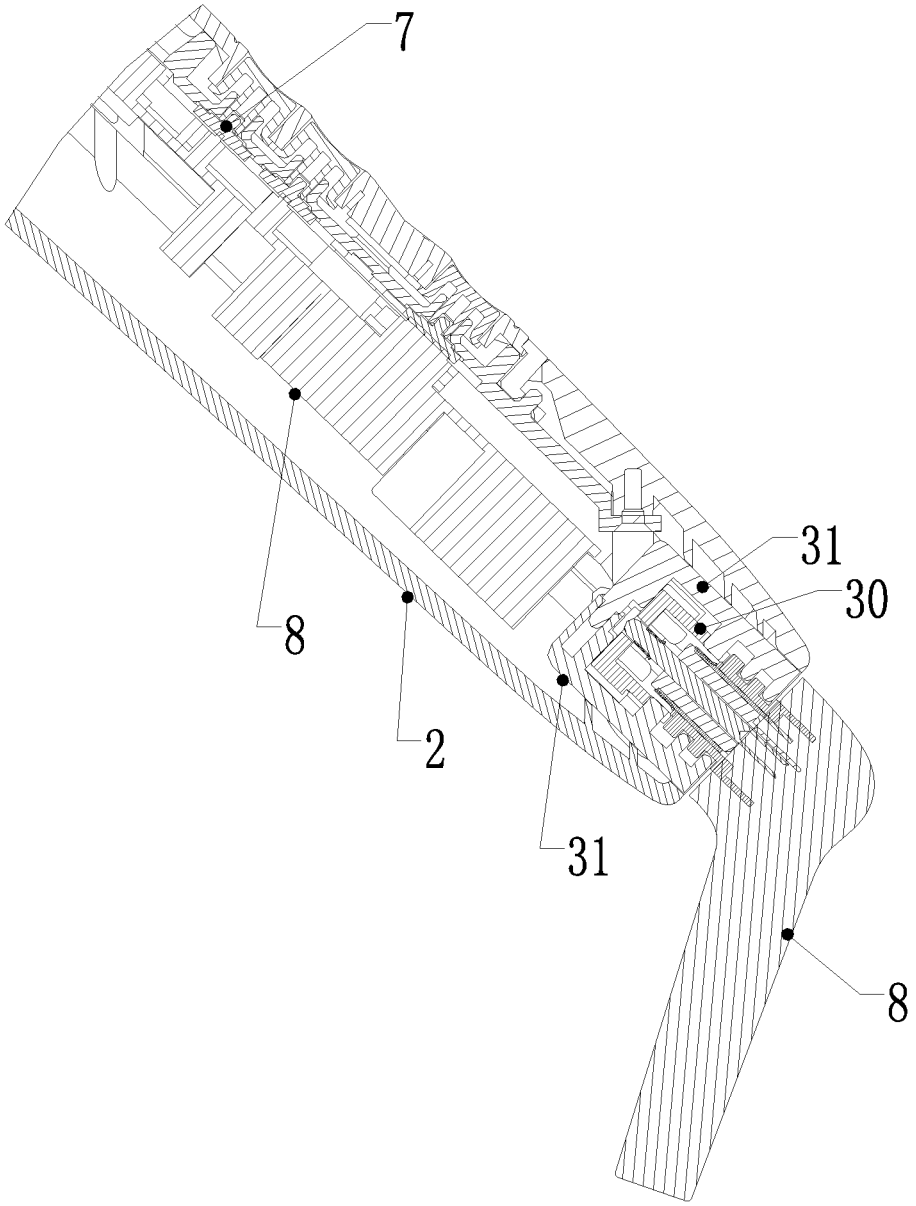
FIG. 8 is an enlarged view of the portion labeled with B in FIG. 2.
Figure 9:
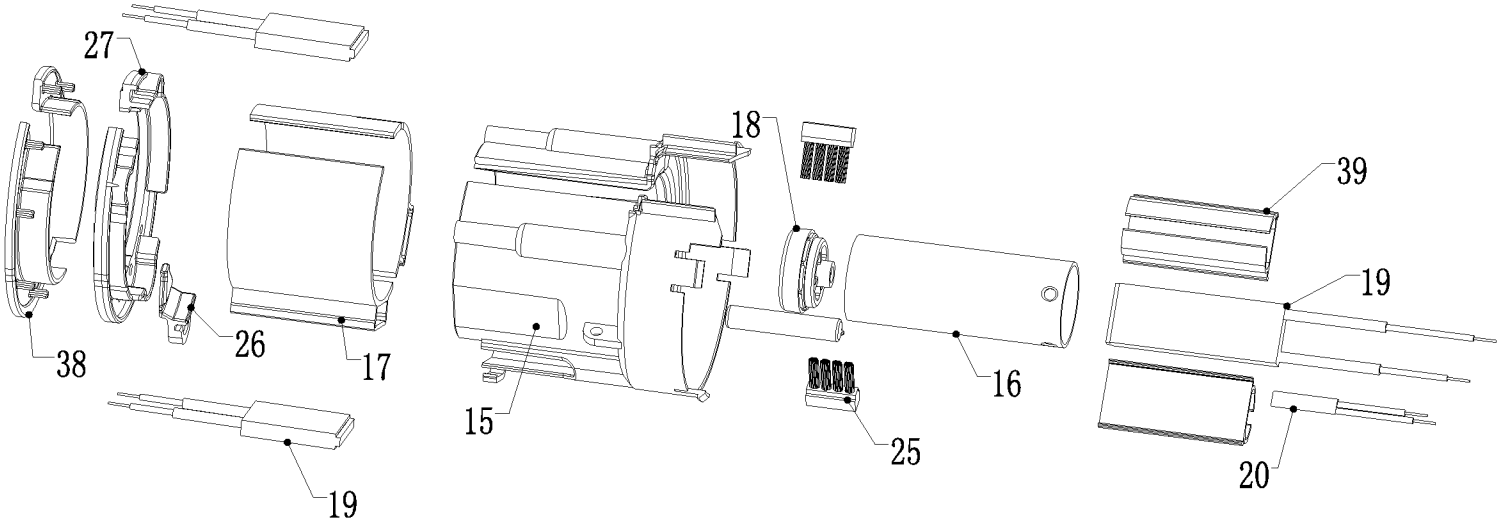
FIG. 9 is an enlarged view of FIG. 3, comprising a side decorated cover, a fixed cover, a sizing silica gel, PTC heaters, a sub heating column, a heating base, a heating column cover, hair combing brushes, a heating column, a PTC bracket and an NTC temperature sensor.
Figure 10:
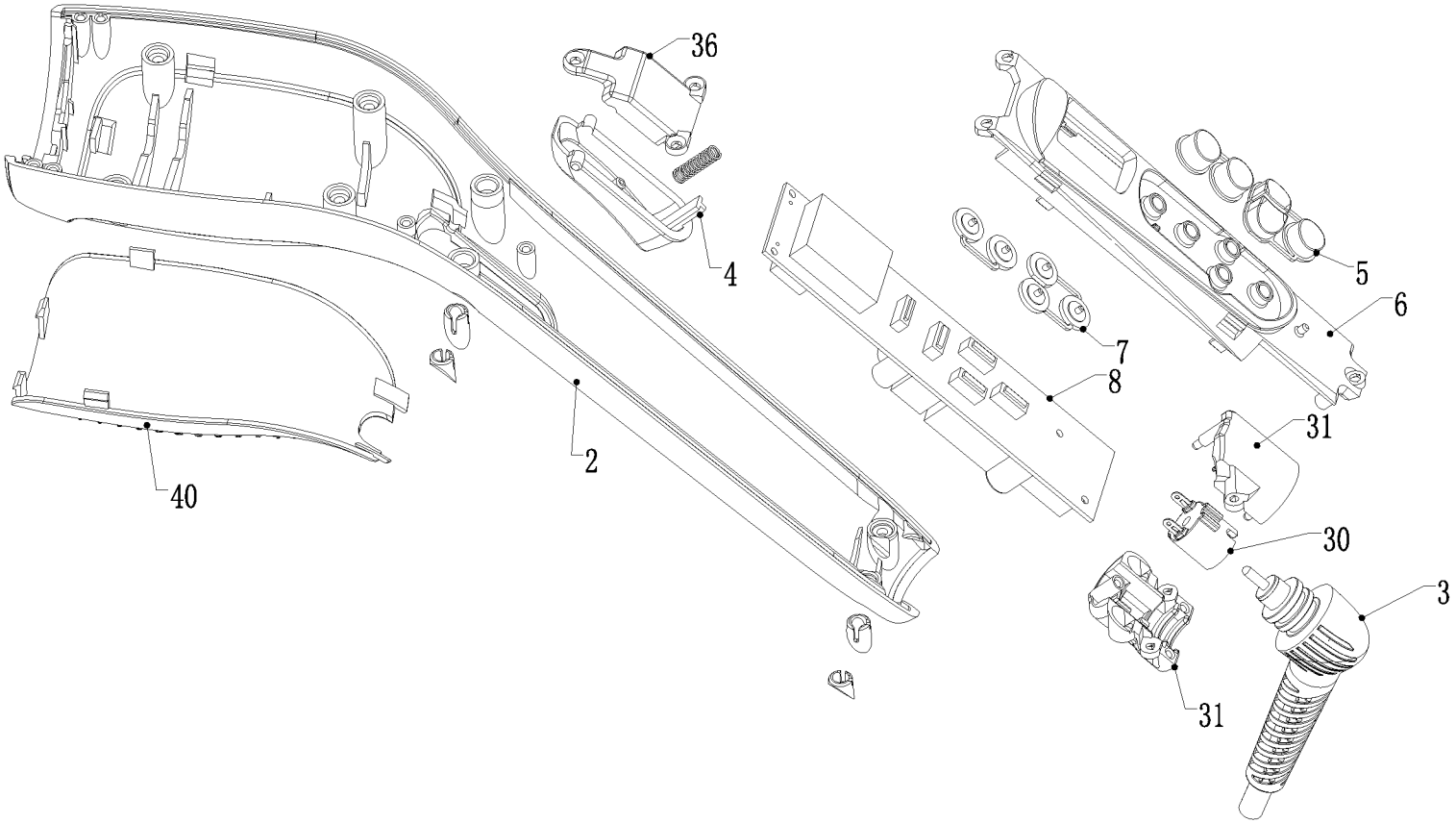
FIG. 10 is an enlarged view of FIG. 3, comprising a lower decorated cover, a second handle shell, a press part cover, a press part, a separator, a PCB, a button, a decorated fixed mount, a power wire, a junction box and junction box lids.
Figure 11:
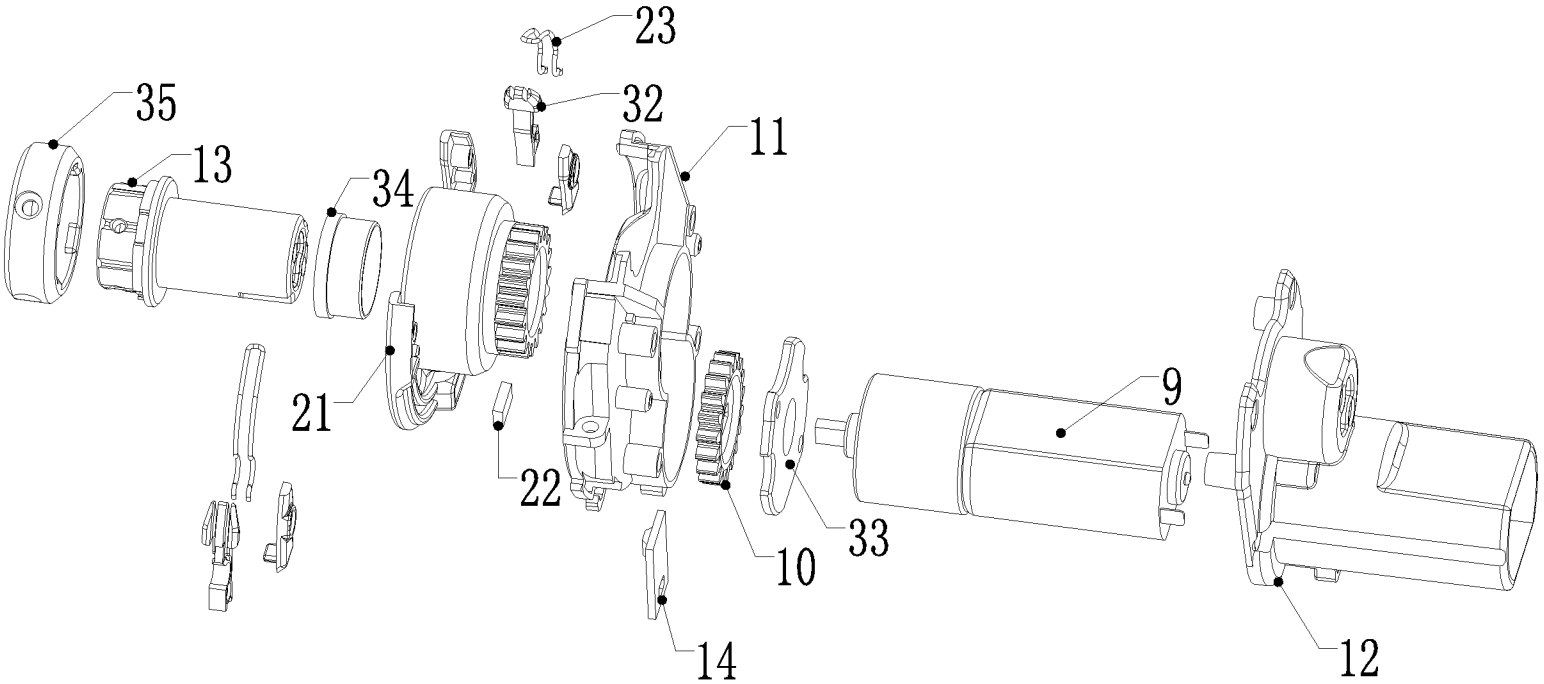
FIG. 11 is an enlarged view of FIG. 3, comprising a connection bush, an open connection, a copper bush, a curling arm, a magnet, a hair steel wire, a steel wire fixed mount, a base cover, a hall sensor, an output gear, a motor cover, a motor and a whole body base.
Figure 12:
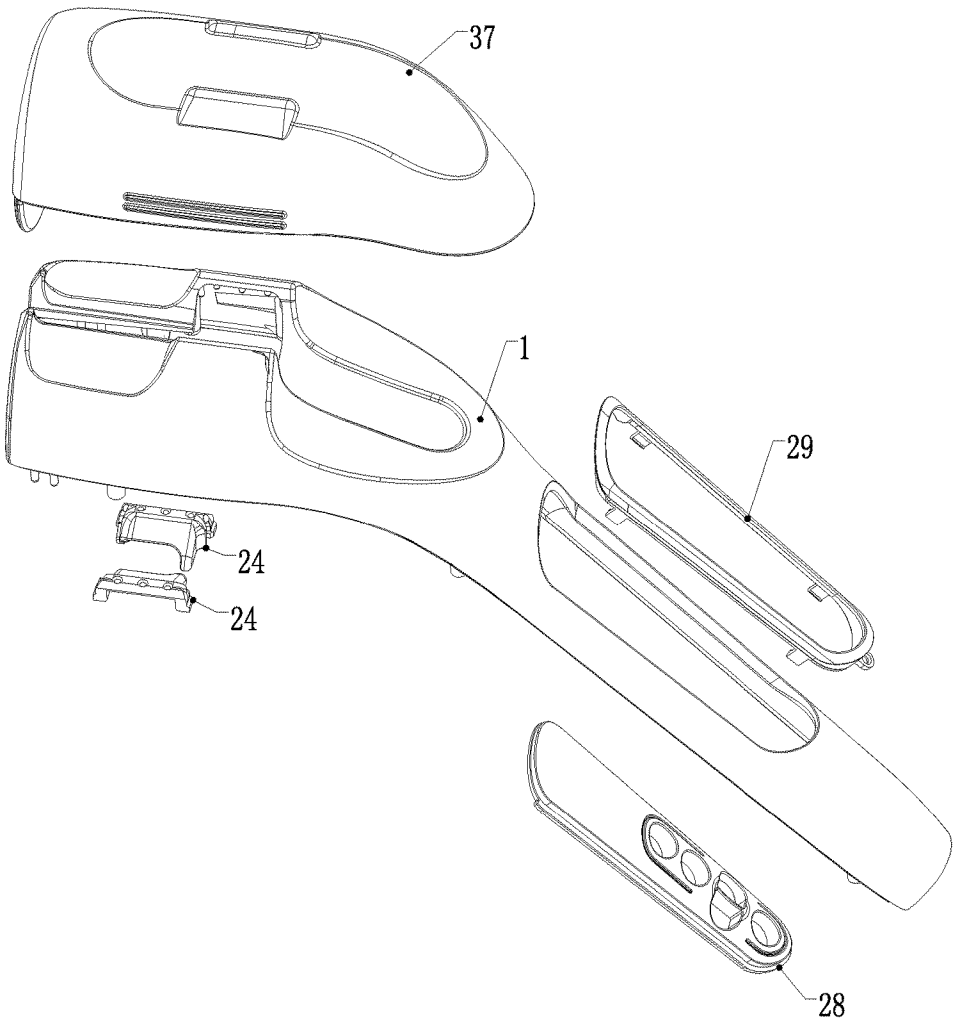
FIG. 12 is an enlarged view of FIG. 3, comprising a protection cover, a first housing, hair grip silica gels, a transparent decorative sheet and a decorative ring.

Referring to FIGS. 4 to 6, in the embodiment, the basic structure of the hair curling hammer is the same as the Embodiment I, expect that the motor 9 and the heat cover base 15 are horizontally installed structure and are located below the heat cover base 15 and adjacent to the bottom of the working part of the hair curling hammer. The motor drive shaft of the motor 9 is connected to the output gear 10, the output gear 10 is engaged with the transmission gear 41. The transmission gear 41 is engaged with the gear structure on the rear part of the hair curling arm, the transmission gear 41 is fixed on the motor base through a copper shaft 42. Since the vertical distance between the motor 9 and the hair curling arm 21 is increased, the power is transmitted upwardly by the motor 9 through the transmission gear 41 and output gear 10, and the motor 9 is connected to the control member at the same time. Specially, in the embodiment, the motor base and base cover are integrated into an integrated member, but it is still defined as the motor base 12.

The above structure has the same function and effect as the Embodiment I, and the operation method and the operating principle thereof are same as the Embodiment I, therefore the description is omitted herein.

In summary, the hair curling hammer of the invention is beautiful in appearance and good in human-computer interface, which generates sufficient heat and power; and is adjustable in temperature, number of circlings, styling time, and direction of rotation, which meets the various requirements of the customer; and the hair curling hammer improves on the hair curling member, the operability and reliability of curling hair is increased greatly; three hair combing brushes are introduced, making the process of curling hair smoother, keeping the curled hair suppler and more beautiful;

providing a retaining wall of silica gel makes the operation more convenient; the implement of the two hair grip silica gels simplifies the operation of the curling hair greatly, makes the operation more convenient and more reliable; by the use of the steel wire for curling hair, the hairs are dispersed by the thin steel wire when the hair is curled, which makes the hair supple, and the hair cannot be messy, and the attractiveness of curled hair is ensured.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A hair curling hammer comprising:

a housing component, a control member, a heating member, a power member, a curling member, and a hair care member;

wherein the housing component is formed by first and second housings detachably assembled by screws and the housing component forms an exterior of the hair curling hammer;

wherein the hair curling hammer comprises a working part at a distal portion of the housing component and a handheld part extending proximally from the distal portion, a proximal end portion of the handheld part is connected to a power line, the control member is fixed in the handheld part, and a switch is arranged between the working part and the handheld part of the hair curling hammer;

wherein the control member includes a button, a decoration fixing mount, a button divider, and a printed circuit board, the button divider is arranged between the printed circuit board and the decoration fixing mount, the button is arranged on the decoration fixing mount, the decoration fixing mount is secured to the printed circuit board through screws and snaps, the decoration fixing mount is fixed on the handheld part of the hair curling hammer, and the control member is connected to the power line;

wherein the power member, the heating member, the curling member and the hair care member are arranged in the working part of the hair curling hammer;

wherein the power member includes a motor, an output gear, a base cover, a motor base, a connecting element, and a Hall sensor, the motor base is fixed in the working part of the hair curling hammer, the motor is arranged in the motor base, the output gear is arranged on a motor drive shaft of the motor, the connecting element is inserted in a groove located at an upper part of the motor base, the base cover is sleeved on the connecting element and covers the motor base and the output gear of the motor, and the Hall sensor is fixed on a lower part of the base cover;

wherein the heating member includes a heat cover base, a heat cover, a sub heat cover, a cover lid, a PTC heater, and a NTC temperature sensor, the heat cover base is fixed in the working part of the hair curling hammer and coupled to a front part of the hair curling arm, the sub heat cover is arranged in the heat cover base, the heat cover sleeves on the connecting element, the PTC heater and the NTC temperature sensor are arranged in the heat cover, and the heat cover lid is embedded in the heat cover;

wherein the hair curling member includes a hair curling arm, a magnet, two steel wires, and a gear structure;

wherein the hair curling arm is sleeved on the connecting element, the magnet is arranged on a lower part of the hair curling arm, the two steel wires for curling hair are arranged on two ends of the hair curling arm respectively, the gear structure is arranged on a rear part of the hair curling arm, and the gear structure is engaged with the output gear;

wherein the hair care member includes a hair grip silica gel, hair combing brushes, and a retaining wall of silica gel; and wherein the hair grip silica gel is arranged in an opening on a top of the working part, the hair combing brush is detachably assembled on a periphery of the sub heat cover, the retaining wall of silica gel is detachably assembled on a fixed cover, the fixed cover is arranged on an outlet located on a distal-most side of the working part, where the distal-most side is arranged transverse to the top of the working part and wherein, rotation of the motor causes rotation of the hair curling arm via engagement of the gear structure and the output gear which causes rotation of the heat cover base via engagement of the heat cover base and the hair curling arm.

2. The hair curling hammer as claimed in claim 1, wherein the motor and the heat cover base are located at one side of the heat cover base and adjacent to an inner side of the working part of the hair curling hammer, the motor and the heat cover base are arranged horizontally, and the motor is connected to the control member.

3. The hair curling hammer as claimed in claim 1, wherein the motor and the heat cover base are located at a lower part of the heat cover base and adjacent a bottom of the working part of the hair curling hammer, and the motor and the heat cover base are arranged horizontally; and wherein the output gear is engaged with a transmission gear, the transmission gear is engaged with the gear structure of the end portion of the hair curling arm, the transmission gear is fixed on the motor base through a copper axle, and the motor is connected to the control member.

4. The hair curling hammer as claimed in claim 1, wherein a shape of the opening is rectangle, and an orientation of the opening is in accordance with a direction of a length of the motor; and wherein the hair combing brushes comprise three hair combing brushes and are arranged on the heat cover base symmetrically with respect to the center of the heat cover.

5. The hair curling hammer as claimed in claim 1, wherein the button is a plurality of buttons including a temperature control button, a styling time control button, a number of rotations control button and a rotational direction control button, the control member also includes a transparent decorative sheet and a decorative ring, the transparent decorative sheet having a plurality of through holes where a number and structure of the plurality of through holes correspond to a number and structure of the plurality of buttons such that the buttons are accessible through the holes; and the transparent decorative sheet is fixed on the decoration fixing mount, and the decorative ring is detachably assembled on the decoration fixing mount through a snap; and wherein a slot, which matches with a structure of the snap of the decorative ring, is arranged on the decoration fixing mount, and the decoration fixing mount is detachably assembled on the housing component.

6. The hair curling hammer as claimed in claim 1, wherein the end portion of the hair curling hammer connected to the power line has a junction box covered by a junction box lid.

7. The hair curling hammer as claimed in claim 1, wherein the hair grip silica gel comprises two hair grip silica gels and are symmetrically arranged adjacent to each other on the top of the first housing of the hair curling hammer; and, the two hair grip silica gels having first ends and an opposing second ends, where the first ends contact each other at a touch point within the opening of the first housing.

8. The hair curling hammer as claimed in claim 1, wherein the two steel wires are arranged on the two ends of the hair curling arm respectively, and the steel wires are fixed on the hair curling arm symmetrically by a steel wire fixing mount.

9. The hair curling hammer as claimed in claim 1, wherein the magnet and the Hall sensor are initially arranged symmetrically; wherein a motor cover is arranged between the motor and the output gear, which is adjacent to the Hall sensor; and wherein the motor cover is sleeved on the motor and abuts against the motor base so as to seal the motor.

10. The hair curling hammer as claimed in claim 1, wherein a copper bushing is sleeved between the hair curling arm and the connecting element, and wherein a plurality of step structures, which match each other, are arranged between the copper bushing and the hair curling arm.

11. The hair curling hammer as claimed in claim 1, wherein a connecting element bushing is sleeved on a joint of the heat cover and the connecting element; and wherein a plurality of step structures, which match with the heat cover and the connecting element bushing respectively, are arranged on the connecting element.

12. The hair curling hammer as claimed in claim 1, wherein a switch cover is arranged on the switch; wherein a spring is arranged between the switch cover and the switch; wherein a spring groove is arranged on the switch cover to mount the spring; and wherein a mounting pillar is arranged on the switch to mount the spring, and the switch forms part of the exterior of the hair curling hammer and is rotatably connected to the switch cover.

13. The hair curling hammer as claimed in claim 1, wherein a protection cover is arranged on a top of the hair curling hammer.

14. The hair curling hammer as claimed in claim 1, wherein the button comprises a temperature control button, a circling number control button, a styling time control button, and a rotational direction control button.

15. A method of curling hair using the hair curling hammer of claim 5 or 14, comprising:

setting the hair curling hammer with a direction of rotation, required temperature for hair curling, styling time, and number of rotations;

placing a strand of hair on the opening at the top of the hair curling hammer and close to the hair grip silica gel; pressing the switch to start rotating the motor, the motor rotating the steel wire to wind hair on the heat cover base gradually while heating the hair with heat generated from the PTC heater inside the heat cover base, the retaining wall of silica gel preventing the hair from loosening during styling of the hair; stopping the motor from rotating after the hair curling arm completes rotating a set number of rotations; a buzzing alert is activated when the styling time has elapsed; and pulling out the hair in a curled state.

* * * * *